United States Patent [19]

Hung

[11] Patent Number: 5,016,317

[45] Date of Patent: May 21, 1991

[54] LIGHTLY-OPERATING AUTOMATIC DOOR CLOSER WITH DOUBLE CYLINDERS

[76] Inventor: Sheng-Hu Hung, P.O. Box 55-1670, Taipei, Taiwan

[21] Appl. No.: 547,137

[22] Filed: May 14, 1990

[51] Int. Cl.[5] ..... E05F 3/20

[52] U.S. Cl. ..... 16/54; 16/58; 16/61; 16/63

[58] Field of Search ..... 16/54, 56, 58, DIG. 9, 16/82, 85, 51, 61, 63, 78, DIG. 17

[56] References Cited

U.S. PATENT DOCUMENTS

| | | | |
|---|---|---|---|
| 842,121 | 1/1907 | Smith | 16/63 |
| 897,825 | 9/1908 | Flynn | 16/61 |
| 3,004,280 | 10/1961 | Stein | 16/54 |
| 3,408,683 | 11/1968 | Zahn | 16/51 |
| 4,317,254 | 3/1982 | Chaddock | 16/61 |
| 4,413,373 | 11/1983 | Sasaki | 16/58 |

FOREIGN PATENT DOCUMENTS

| | | | |
|---|---|---|---|
| 350140 | 6/1931 | United Kingdom | 16/54 |

*Primary Examiner*—Kurt Rowan
*Assistant Examiner*—Chuck Y. Mah

[57] ABSTRACT

An automatic door closer includes: a casing having a primary and a secondary cylinder juxtapositionally formed in the casing for resiliently holding two pistons in the two cylinders filled with a hydraulic oil and partitioned with a wall formed with a main hole and a throttling hole for communicating the two cylinders, wherein each piston is normally urged by a tensioning spring towards the two holes in the casing, whereby upon an opening of the door, an upper piston is retracted to compress an upper spring in the primary cylinder to suck oil from the secondary cylinder to the primary cylinder and also to extend the lower piston and tension the lower spring for accelerating a door opening operation and saving the door-opening force; and a positioning device provided for temporarily keeping the door at its opened state by locking a positioning pin in a recess formed in the upper piston.

8 Claims, 3 Drawing Sheets

LIGHTLY-OPERATING AUTOMATIC DOOR CLOSER WITH DOUBLE CYLINDERS

BACKGROUND OF THE INVENTION

Grisebach disclosed a damping device for hinges and the like in his U.S. Pat. No. 3,952,365 including a spring for biasing a door or other similar structure into a closed position and a fluid medium for damping movement of the door. The damping effect is achieved by compelling the fluid to pass from one chamber to another within a housing of the device by changing the volumes of the chambers, the spring itself bring used to being about the change in volume.

However such a damping device still has the following drawbacks:

1. In view of a valve flap 33 as shown in FIG. 2 of the Griseback's disclosure, the frequent opening and closing operations of the flap 33 may easily cause fatigue failure to the resilient flap, thereby losing its valve effect and reducing the damping effect of the device.

2. There is not provided with any temporary locking or positioning device for temporarily holding the door at any opening state so that an additional locking or positioning mechanism should be further installed for keeping a temporary door opening state.

3. The pressure-volume worked by the working fluid stored in the cylindrical housing with tiny space is quite limited, thereby causing a very small damping effect.

The present inventor has found the drawbacks of the conventional damping device of a door hinge and invented the present automatic door closer which can be operated by a lighter force.

SUMMARY OF THE INVENTION

The object of the present invention is to provide an automatic door closer having a driving piston and a follower piston respectively held in a primary cylinder and a secondary cylinder formed in a casing secured on a door hinge, whereby upon an opening of a door secured with the hinge and the two cylinders, the driving pistion may be compressed for restoring its closing potential and also to suck a hydraulic oil from the secondary cylinder towards the primary cylinder for accelerating the door opening movement for a lighter door opening; and upon a closing of the door, the follower piston can be compressed for damping the oil returned from the primary cylinder.

DETAILED DESCRIPTION

Figure 1:
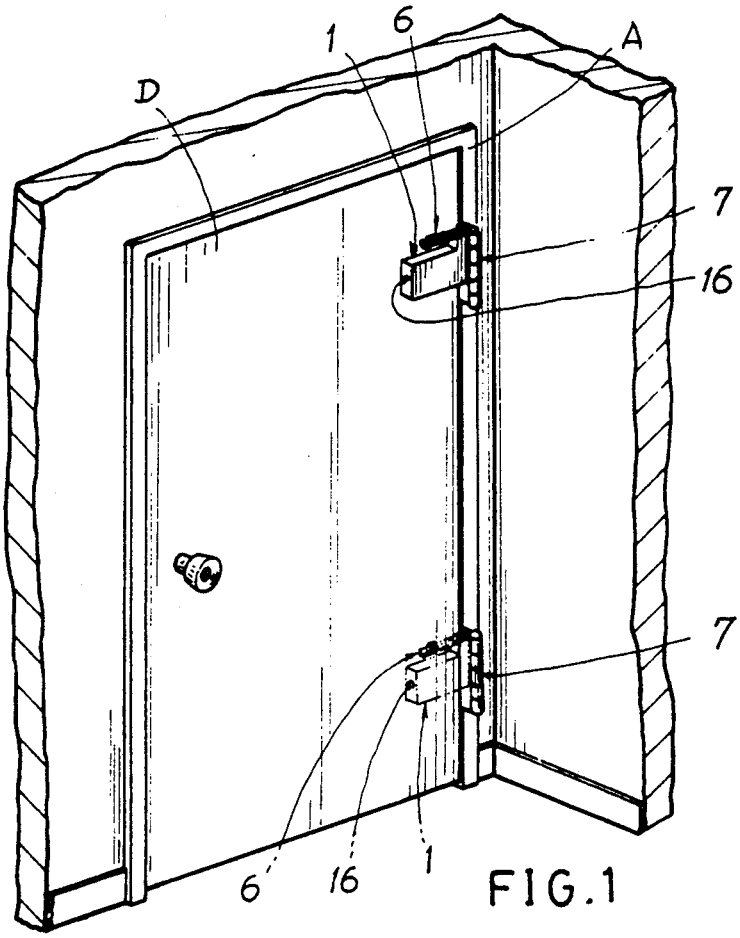
FIG. 1 is a illustration showing an application when installing the present invention on a door.

As shown in FIG. 1–4, the present invention comprises: a casing 1, a driving pistion 2, a follower piston 3, a link set 4, a positioning pin 5, a biasing plate 6 and a door hinge 7.

The casing 1 includes: a primary cylinder 11 for slidably sealably holding the driving piston 2 therein, a secondary cylinder 12 partitioned from the primary cylinder 11 with a partition wall 10' and juxtapositional to the primary cylinder for slidably sealably holding the follower piston 3 therein, a main hole 13 and a throttling hole 14 formed in an outer portion of the casing respectively communicating the two cylinders 11, 12.

The driving piston 2 is normally urged by a first tensioning spring 21 towards an outer portion in the casing 1 having the main hole 13 and the throttling hole 14 formed therein. The inner end portion of the piston 2 is formed with an annular recess 22 along a perimeter of the piston 2 and a tapered periphery 24 formed on the outermost end of the piston 2 adjacent to the recess 22. A sleeve connector 23 is formed inside an outer portion of the piston 2 defining a cylindrical bore portion 231 for coupling a spherical end portion 42 of the link set 4.

The follower piston 3 is normally tensioned by a second tensioning spring 31 towards the outer portion of the casing 1 provided with the holes 13, 14. A venting hole 121 is formed in an inner end portion of the secondary cylinder 12 of the casing 1. A hydraulic oil 10 is filled in the two cylinders 11, 12 between the two pistons 2, 3, which oil 10 is fluidically communciated between the two cylinders 11, 12 through the two holes 13, 14. The throttling hole 14 is formed in an outermost end portion of the casing 1 adjacent to the main hole 13 including an adjusting screw 15 having a conical body 15 adjustably closing or opening the hole 14, which screw 16 can be adjusted such as by a driver outside the casing 1.

Figure 3:
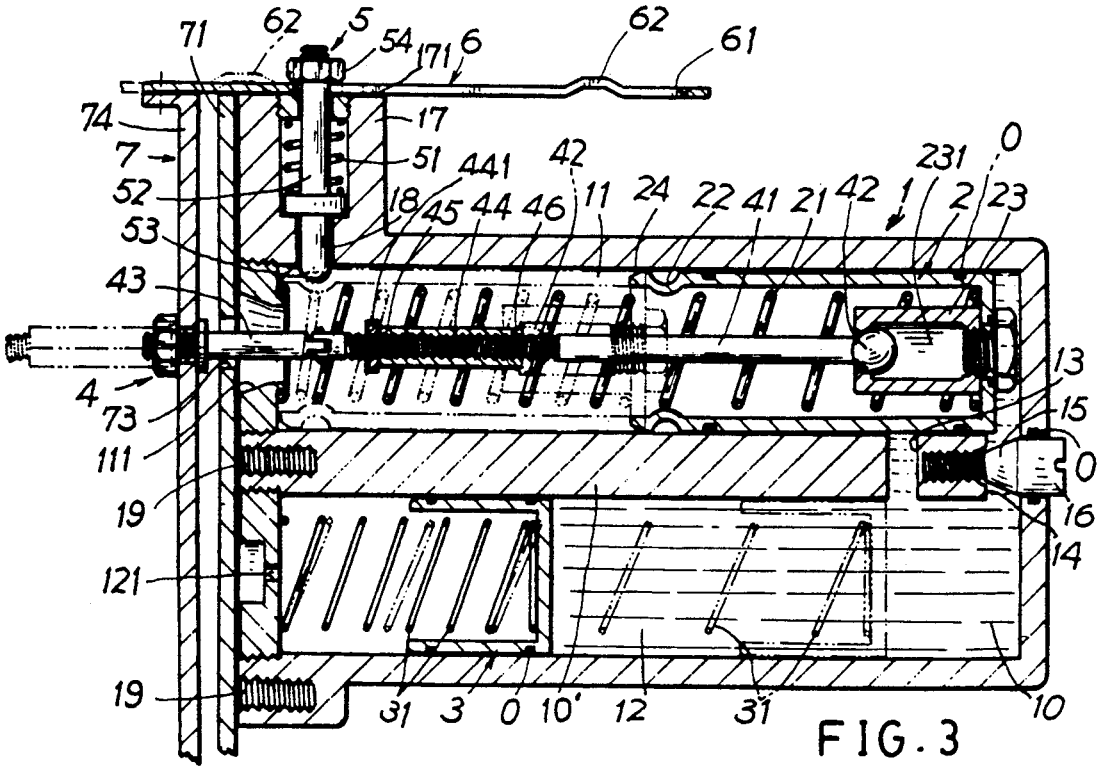
FIG. 3 is a front elevational sectional drawing of the present invention.

The link set 4 jacketed with the first spring 21 includes a long rod 41 having its outer end portion secured with the spherical end portion 42 slidably coupled with the sleeve connector 23 of the piston 2 and having its inner end portion formed with two male-threaded portions 45, 46 connected by a female-threaded coupler 44; and a short rod 43 having an outer end portion of the rod 43 pivotally secured to the long rod 41 and having an inner end portion of the rod 43 fixed on a fixed leaf 74 of the hinge 7. The short rod 43 protrudes inwardly through an enlarged port 111 formed in an inner end of the cylinder 11 and a lateral slot 73 formed in a movable leaf 71 of the hinge 7. The two male-threaded portions 45, 46 are threaded leftwardly and rightwardly respectively engageable with the female-threaded hole in the coupler 44 as shown in FIG. 3 for adjusting the length of the link set 4, which is retained by a nut 441 fixed on the inner end porton of the rod 43.

The positioning pin 5 includes a pin portion 52 normally resiliently protruding downwardly as urged by a restoring spring 51 disposed around the pin 52, a lower tip portion 53 protruding through a pin hole 18 formed in a pin holder 17 formed on an inner portion of the casing 1 proximate to the enlarged port 111 of the primary cylinder 11 and an extension nut 54 formed on the upper portion of the pin 5 over the upper surface 171 of the pin holder 17. The tip portion 53 is operatively engaged with the annular recess 22 formed in the piston 2.

The biasing plate 6 generally formed as a longitudinal plate includes: a longitudinal slot 61 formed therein for free passing an upper portion of the pin 5 between the extension nut 54 and the upper surface 171 of the holder 17, an inner end portion 63 pivotally secured to the fixed leaf 74 of hinge 7, an outer flat end portion 64 formed on the outer portion of the slot 61, and a convex portion 62 protruding upwardly near the outer end portion 64. The plate 6 is generally horizontally suspending above the hinge 7 and the pin holder 17. The length of the slot 61 is slightly larger than the moving stroke of the piston 2. The extension nut 54 may be operatively lifted to pass the convex portion 62 of the biasing plate 6 to disengage the pin 5 from the recess 24 of the piston 2. An aperture between the nut 54 and the upper surface 171 of the pin holder 5 is generally equal to a thickness of the biasing plate 6 for a sliding engagement between the pin 5 and the plate 6 when the pin 5 is normally urged downwardly by the spring 51.

Figure 4:
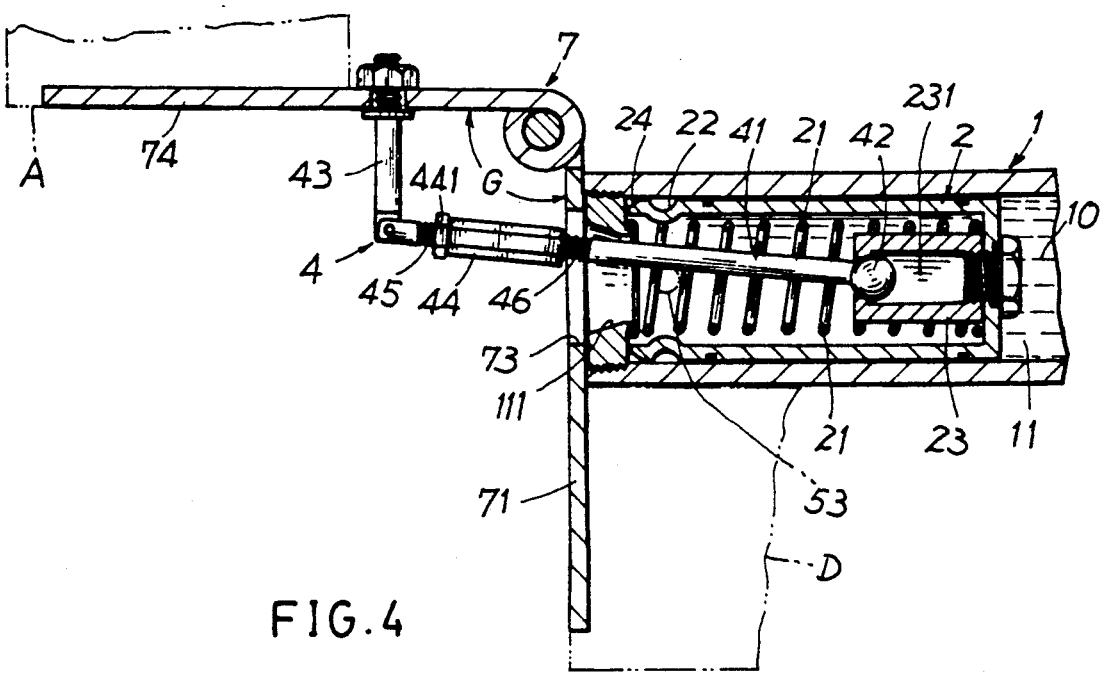
FIG. 4 shows a top-view partial sectional drawing of the present invention.

The hinge 7 includes a movable leaf 71 secured with the door D and the casing 1 by fixing bolts through the holes 72 formed in leaf 71 and holes 19 formed in casing 1, and a fixed leaf 74 pivotally connected with the movable leaf 71 fixed on a door frame A. The link set 4 is normally perpendicular to the fixed leaf 74 when the door D is closed with the door frame A as shown in FIG. 3. The width of leaf 71 or 74 is generally equal to the thickness of the door D and the thickness of the casing 1 as shown in FIG. 4. The bolt hole 75 formed in the leaf 71 may be inserted with bolts (not shown) to separate or partition the two leaves 71, 74 for the fixation on the door D and the frame A. The slot 73 and port 111 should be well designed not to obstruct the movement of the link set 4. Several packing rings 0 are formed in movable elements such as piston 2, 3, the screw 16 for preventing oil leakage from the cylinders 11, 12.

Figure 2:
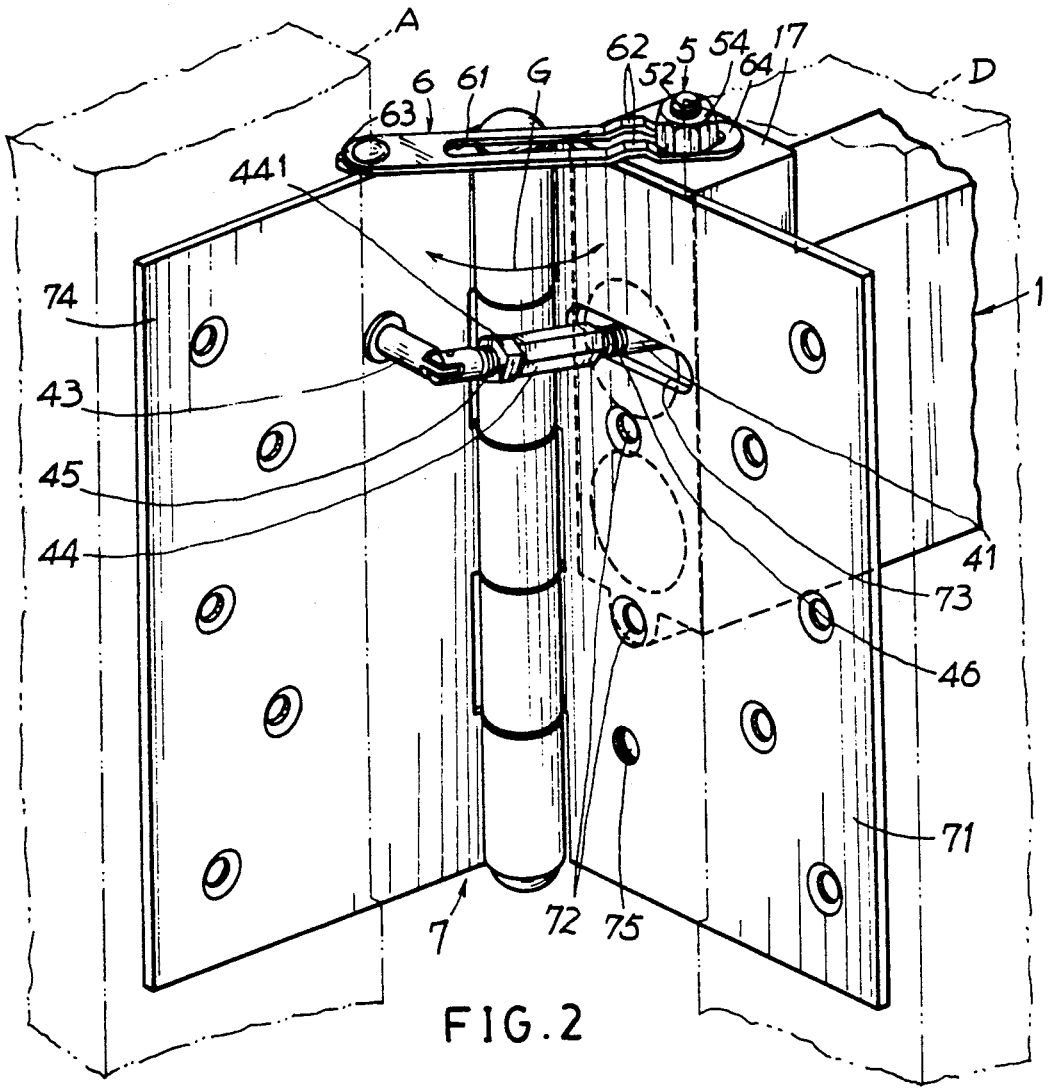
FIG. 2 is a perspective view of the present invention.

When using the present invention for opening a door D, the door opening operation will retract the rod 41 to move the piston 2 inwardly or leftwardly to compress the spring 21 as shown in FIG. 4 and as shown in dotted line of FIG. 3 and will suck the hydraulic oil 10 from the secondary cylinder 12 to the primary cylinder 11 through the two holes 13, 14 to tension the second spring 31 as shown in dotted line of FIG. 3 so that the quick oil flow from the secondary cylinder 12 to the primary cylinder 11 will accelerate the door opening movement for saving its operational force. The positioning pin 5 will also be guided through the longitudinal slot 61 of the biasing plate 6 until the extension nut 54 passes over the convex portion 62 of the biasing plate 6 (the tapered periphery 24 of piston 2 will first bias the pin tip 53 upwardly without locking the piston 2) to engage the tip portion 53 of the pin 5 with the recess 22 of the piston 2 as shown in dotted line of FIG. 3 and a perspective view in FIG. 2. The engagement of the pin 5 with the piston 2 should have a locking force enough to overcome the tension force of the two springs 21, 31 so that the door can be stably opened as shown in FIG. 2, 4 and the extension nut 54 of the pin 5 is also retarded beyond the convex portion 62 of the biasing plate 6 for positioning the opening door.

The first spring 21 as compressed when opening the door will restore its potential energy which should be greater than the tension force of the second spring 31. When the door D is opened to its greatest angle G (which angle can be adjusted by the coupler 44) as shown in FIGS. 2, the piston 2 is moved to the innermost position as shown in dotted line of FIG. 3 to be locked by engaging the recess 22 with the tip portion 53 of pin 5 and the spherical end portion 42 of the rod 41 is pulled to the innermost (left) position in the cylindrical bore portion 231 of the sleeve connector 23.

When pushing to close the door D to the door frame A, the extension nut 54 of the positioning pin 5 is first lifted by the convex portion 62 of the biasing plate 6 to disengage the pin tip 53 from the recess 22 of the piston 2, the piston 2 as urged by the compressed spring 21 will be restored towards the outer portion of the casing 1 to extend the rod 41 and the piston 2 to automatically close the door D. The oil 10 will also be pumped and returned from the primary cylinder 11 to the secondary cylinder 12 through the holes 13, 14. After the piston 2 is moved beyond the main hole 13, the returning oil is then directed through the unique hole 14 to slow down the door closing movement in order to prevent any suddenly impact force caused by the closing door. The oil 10 will be returned into secondary cylinder 12 to compress the follower piston 3 and the second spring 31 to damp the door closing force.

When initiating the closing of the door D by lifting the nut 54 of the pin 5, even the door D and the casing 1 are inwardly moved slightly, but not retarded by the rods 41, 43 becaused the cylindrical bore portion 231 of the sleeve connector 23 fixed in the piston 2 serves as a "buffer zone" allowing their retraction movement to first disengage the pin 5 by the biasing plate 6. The throttling hole 14 can be adjusted for adjusting the oil flow rate depending upon the damping effect required for closing the present door.

Figure 5:
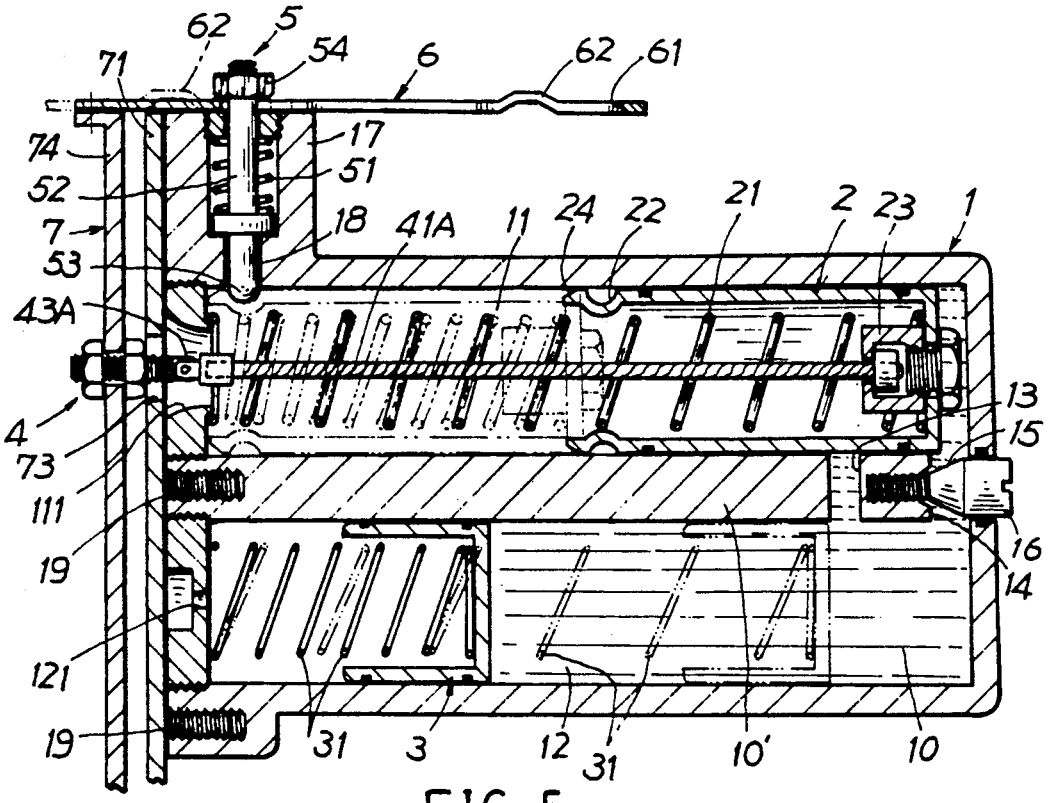
FIG. 5 is an illustration showing another preferredc embodiment of the present invention.
Figure 6:
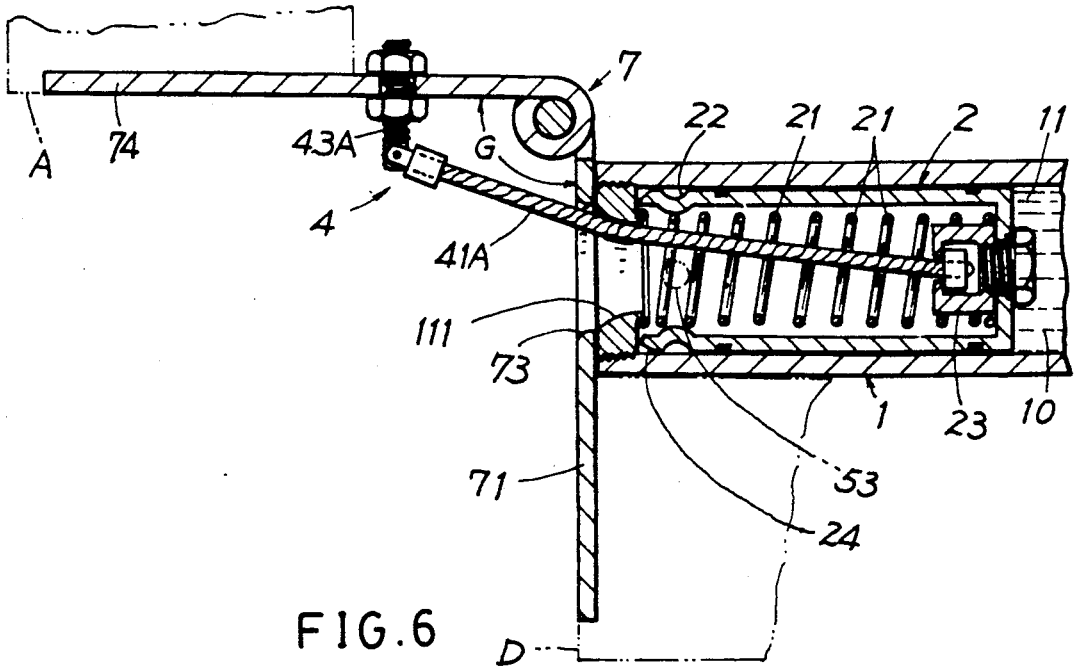
FIG. 6 is a top view illustration of FIG. 5.

Another preferred embodiment of the present invention is shown in FIGS. 5, 6, in which the link set 4 as aforementioned is substituted with a wire rope 41A having its inner end pivotalloy secured to an adjusting screw **43*a* fixed on the hinge leaf 74 and having its outer end secured to the connector 23 formed in the piston 2. When closing the door, the wire rope 41*a* can be bent without retarding the closing operation of the piston 2**.

The present invention is superior to a conventional door closer with the following advantages:

1. Double cylinders 11, 12 with two pistons 2, 3 are provided for greatly damping a door closing shock. Also, the door opening can be operated in an accelerated rate with a lighter force.

2. A door opening positioning device is provided by engaging the pin with the piston so that the door can be temporarily kept at its opening state. Such a positioning device can be easily released by disengaging the pin 5 from the piston 2 as triggered by the biasing plate.

3. The cylinders and casing can be stored with greater volume of hydraulic oil and the springs 21, 31 can also be made longer for saving operational force or for increasing much damping effect.

I claim:

1. An automatic door closer comprising:

a casing having a primary cylinder and a secondary cylinder juxtapositionally formed on a movable leaf of a door hinge fixed with a door, said door hinge having a fixed leaf fixed on a door frame pivotally secured to the movable leaf, said primary cylinder partitioned from said secondary cylinder by a partition wall formed with a main hole and a throttling hole in an outer end portion in said casing for communicating said two cylinders;

a driving piston resiliently held in said primary cylinder and normally urged by a first tensioning spring towards two said holes in said casing;

a link set disposed therearound by said first tensioning spring pivotally connected between said fixed leaf of said door hinge and said driving piston;

a follower piston resiliently held in said secondary cylinder and normally urged by a second tensioning spring towards the outer portion of said casing;

a hydraulic oil filled in both said cylinders defined between the driving piston and the follower piston;

a positioning pin resiliently protruding downwardly from a pin holder formed on an inner portion of said casing for operatively engaging an annular recess formed in an inner periphery of said driving piston for locking the door at an opening state; and a biasing plate pivotally secured and horizontally suspended to said fixed leaf of said door hinge having a longitudinal slot formed therein for free passing said pin and having a convex portion extending upwardly from said plate for operatively lifting said pin for desengaging said pin from said driving piston, whereby upon an opening of said door from said door frame said driving piston is moved inwardly to compress said first tensioning spring to suck the hydraulic oil from said secondary cylinder to said primary cylinder through said two holes and to extend the follower piston to tension the second tensioning spring for accelerating the door opening operation for saving the door-opening operational force, and upon a closing for the door, the compressed first spring is restored to automatically close the door and to urge the driving piston to return the oil into the secondary cylinder for compressing the second spring in said secondary cylinder through said main hole and said throttling holes for damping any shock caused in closing the door.

2. An automatic door closer according to claim 1, wherein said first tensioning spring has a tension force greater than that of said second tensioning spring.

3. An automatic door closer according to cliam 1, wherein said throttling hole is provided with an adjusting screw formed in an outer portion of said casing have a conical body formed in said screw for operatively adjusting the throttling hole.

4. An outomatic door closer according to claim 1, wherein said link set includes a long rod having its outer end portion pivotally secured to an outer portion of said driving piston, and a short rod having its outer end portion pivotolly connected to an inner end portion of the long rod having an inner end portion of the short rod pivotally secured to said fixed leaf of said door hinge through an enlarged port formed in an inner portion of said primary cylinder and through a lateral slot formed in the movable leaf of the door hinge.

5. An automatic door closer according to claim 4, wherein the outer end portion of said long rod is formed as a spherical end portion pivotally secured to a sleeve connector formed in said driving piston, said sleeve connector formed with a cylindrical bore portion therein for a slight sliding movement of said spherical end portion of said rod therein,

6. An automatic door closer according to claim 4, wherein said long rod of said link set further includes a coupler formed with two female-threaded holes therein respectively engageable with a rightwardly-threaded male-thread rod portion secured to the long rod and a leftwardly-threaded male-thread rod portion pivotally secured to the short rod for adjusting a length of said long rod.

7. An automatic door closer according to claim 1, wherein said link set is a wire rope connected between said driving piston and said fixed leaf of said door hinge.

8. An automatic door closer according to claim 1, wherein said positioning pin includes a lower tip portion formed on a lower portion of a pin portion resiliently held in said pin holder as restored by a restoring spring disposed around the pin portion, said lower tip portion operatively engaging said annular recess formed in said driving piston, said driving piston having a tapered periphery formed on an innermost end of said driving piston for biasing said tip portion for disengaging said pin from said driving piston; and an extension nut formed on an upper portion of said pin over an upper surface of the pin holder to be operatively lifted by the convex portion formed on said biasing lever.

* * * * *